US011608540B2

(12) United States Patent
Park et al.

(10) Patent No.: US 11,608,540 B2
(45) Date of Patent: Mar. 21, 2023

(54) GRAIN-ORIENTED ELECTRICAL STEEL SHEET AND MANUFACTURING METHOD THEREFOR

(71) Applicant: POSCO, Pohang-si (KR)

(72) Inventors: Chang Soo Park, Pohang-si (KR); Kyu-Seok Han, Pohang-si (KR); Hyung Don Joo, Pohang-si (KR); Jae Kyoum Kim, Pohang-si (KR); Woo-Sin Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 118 days.

(21) Appl. No.: 16/472,249

(22) PCT Filed: Dec. 21, 2017

(86) PCT No.: PCT/KR2017/015206
§ 371 (c)(1),
(2) Date: Jun. 21, 2019

(87) PCT Pub. No.: WO2018/117674
PCT Pub. Date: Jun. 28, 2018

(65) Prior Publication Data

US 2019/0323105 A1 Oct. 24, 2019

(30) Foreign Application Priority Data

Dec. 22, 2016 (KR) ..... 10-2016-0177078

(51) Int. Cl.

| | |
|---|---|
| ***C21D 9/46*** | (2006.01) |
| ***C21D 1/74*** | (2006.01) |
| ***C21D 6/00*** | (2006.01) |
| ***C21D 8/00*** | (2006.01) |
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/16*** | (2006.01) |

(52) U.S. Cl.
CPC ..... *C21D 9/46* (2013.01); *C21D 1/74* (2013.01); *C21D 6/005* (2013.01); *C21D 6/008* (2013.01); *C21D 8/005* (2013.01); *C21D 8/1272* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/16* (2013.01); *C22C 2202/02* (2013.01)

(58) Field of Classification Search
CPC ..... C21D 9/46; C22C 38/001
USPC ..... 148/111
See application file for complete search history.

(56) References Cited

U.S. PATENT DOCUMENTS

2017/0335425 A1* 11/2017 Joo ..... C22C 38/002

FOREIGN PATENT DOCUMENTS

| | | | | |
|---|---|---|---|---|
| CN | 103525999 | A | 1/2014 | |
| EP | 0392534 | A1 | 10/1998 | |
| EP | 0957180 | A2 | 11/1999 | |
| EP | 2940170 | A1 | 11/2015 | |
| EP | 3235919 | A1 | 10/2017 | |
| JP | H01-230721 | A | 9/1989 | |
| JP | H01-283324 | A | 11/1989 | |
| JP | H02-274813 | A | 11/1990 | |
| JP | H02-305921 | A | 12/1990 | |
| JP | H11-323438 | A | 11/1999 | |
| JP | 2000-034521 | A | 2/2000 | |
| JP | 2002-275534 | A | 9/2002 | |
| JP | 2005-264280 | A | 9/2005 | |
| JP | 2015-526597 | A | 9/2015 | |
| JP | 2016-509625 | A | 3/2016 | |
| KR | 10-0580356 | B1 | 5/2006 | |
| KR | 10-2008-0010439 | A | 1/2008 | |
| KR | 10-2013-0140208 | A | 12/2013 | |
| KR | 10-2015-0073802 | A | 7/2015 | |
| KR | 10-2016-0072704 | A | 6/2016 | |
| KR | 10-1647655 | B1 | 8/2016 | |
| WO | 2016/098917 | A1 | 6/2016 | |
| WO | WO-2016098917 | A1 * | 6/2016 | ..... C22C 38/06 |

OTHER PUBLICATIONS

Chinese Office Action dated Jul. 17, 2020 issued in Chinese Patent Application No. 201780080033.3.
Japanese Office Action dated Jul. 7, 2020 issued in Japanese Patent Application No. 2019-534308.
International Search Report and Written Opinion dated Apr. 4, 2018 issued in International Patent Application No. PCT/KR2017/015206 (with partial English translation).
Extended European Search Report dated Oct. 22, 2019 issued in European Patent Application No. 17884432.0.

* cited by examiner

*Primary Examiner* — Weiping Zhu
(74) *Attorney, Agent, or Firm* — Morgan, Lewis & Bockius LLP

(57) ABSTRACT

A grain-oriented electrical steel sheet of an embodiment of the present invention comprises Si: 1.0% to 7.0% and Y: 0.005% to 0.5% by wt %, and the remainder comprising Fe and other inevitable impurities, and 10 pieces or less of inclusions comprising Y and having a diameter of 30 nm to 5 μm per area of 1 $mm^2$.

16 Claims, No Drawings

GRAIN-ORIENTED ELECTRICAL STEEL SHEET AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/015206, filed on Dec. 21, 2017, which in turn claims the benefit of Korean Application No. 10-2016-0177078, filed on Dec. 22, 2016, the entire disclosures of which applications are incorporated by reference herein.

FIELD OF THE INVENTION

The present invention relates to a grain-oriented electrical steel sheet and manufacturing method thereof. More particularly, the present invention relates to a grain-oriented electrical steel sheet in which inclusions comprising Y are precipitated in an appropriate distribution, and manufacturing method thereof.

DESCRIPTION OF THE RELATED ART

The oriented electrical steel sheet is composed of grains having a Goss orientation in which the grain orientation of the steel sheet is {110}<001> and is a soft magnetic material having excellent magnetic properties in the rolling direction.

In general, the magnetic properties of an electrical steel sheet may be described by magnetic flux density and iron loss, and a high magnetic flux density may be obtained by precisely aligning the orientation of the grains in the {110}<001> orientation. The electrical steel sheet having a high magnetic flux density not only makes it possible to reduce the size of the iron core material of the electric device, but also reduces the hysteresis loss, thereby achieving miniaturization and high efficiency of the electric device at the same time. Iron loss is a power loss consumed as heat energy when an arbitrary alternating magnetic field is applied to a steel sheet, and it largely changes depending on the magnetic flux density and the thickness of the steel sheet, the amount of impurities in the steel sheet, specific resistance and the size of the secondary recrystallization grain, wherein the higher the specific resistance and the lower the thickness and the amount of impurities in the steel sheet, the lower the iron loss and the higher the efficiency of the electric device.

Currently, it is a worldwide trend to reduce the generation of $CO_2$ and cope with global warming by promoting energy-saving and high-efficiency commercialization, and as the demand for expanding and spreading high-efficiency electrical equipment using less electric energy is increased, the social demand for the development of a grain-oriented electrical steel sheet having low iron loss properties is increasing.

Generally, a grain-oriented electrical steel sheet having excellent magnetic properties is required to strongly develop a goss texture in the {110}<001> orientation in the rolling direction of the steel sheet, and in order to form such a texture, the grains of the Goss orientation should form an abnormal grain growth called secondary recrystallization. This abnormal grain growth occurs when the movement of grain boundary in which grains normally grow is suppressed by precipitates, inclusions, or elements that are dissolved or segregated in the grain boundaries, unlike ordinary crystal grain growth. As described above, precipitates and inclusions that inhibit grain growth are specifically referred to as grain growth inhibitors, and studies on the production technology of grain-oriented electrical steel sheets by secondary recrystallization of {110}<001> orientation have been focused on securing superior magnetic properties by using a strong grain growth inhibitor to form secondary recrystallization with high integration to {110}<001> orientation.

In the conventional grain-oriented electrical steel sheet technology, precipitates such as AlN and MnS[Se] are mainly used as a grain growth inhibitor. For example, there is a manufacturing method in which, after decarburization is performed after one-time cold-rolling, nitrogen is supplied to interior of the steel sheet through a separate nitriding process using ammonia gas to cause secondary recrystallization by an Al-based nitride exhibiting a strong grain growth inhibiting effect.

However, the increased instability of the precipitates due to denitriding or nitriding by the atmosphere in the furnace in the high-temperature annealing process and the necessity of the long purification annealing for 30 hours or more at a high temperature have the complication in the manufacturing process and the cost burden.

For this reason, recently, a method for manufacturing a grain-oriented electrical steel sheet without using a precipitate such as AlN or MnS as a grain growth inhibitor has been proposed. For example, there is a manufacturing method using grain boundary segregation elements such as barium (Ba) and yttrium (Y).

Ba and Y have the advantage of being excellent in the effect of inhibiting the growth of grains enough to form secondary recrystallization and being free from the influence of the atmosphere in the furnace during the high temperature annealing, but there is a disadvantage in that a large amount of a secondary compound is formed in the steel sheet such as carbides, nitrides, oxides or Fe compounds of Ba and Y in the manufacturing process. Such a secondary compound has a problem that the iron loss property of the final product is deteriorated.

CONTENTS OF THE INVENTION

Problem to Solve

In one embodiment of the present invention, a grain-oriented electrical steel sheet in which inclusions comprising Y are precipitated in an appropriate distribution to improve magnetic properties and a method for manufacturing the same are provided.

Problem to Solve

The grain-oriented electrical steel sheet according to an embodiment of the present invention comprises: Si: 1.0 to 7.0% and Y: 0.005 to 0.5% by wt %, and the remainder comprising Fe and other inevitable impurities, and 10 pieces or less of inclusions comprising Y and having a diameter of 30 nm to 5 μm per area of 1 $mm^2$.

TECHNICAL SOLUTION

The grain-oriented electrical steel sheet according to an embodiment of the present invention may further comprise: Mn: 0.01% to 0.5%, C: 0.005% or less (excluding 0%), Al: 0.005% or less (excluding 0%), N: 0.0055% or less (excluding 0%) and S: 0.0055% or less (excluding 0%) by wt %.

The grain-oriented electrical steel sheet according to an embodiment of the present invention may further comprise:

0.01 to 0.2 wt % of at least one of P, Cu, Cr, Sb, Sn and Mo, respectively singly or in a total amount.

The inclusions may comprise at least one of a carbide of Y, a nitride of Y, an oxide of Y, and an Fe—Y compound.

3 to 9 pieces of the inclusions per area of 1 $mm^2$ may be comprised.

The method for manufacturing a grain-oriented electrical steel sheet according to an embodiment of the present invention comprises: heating a slab comprising Si: 1.0 to 7.0%, Y: 0.005 to 0.5% by wt %, and the remainder comprising Fe and other inevitable impurities; hot-rolling the slab to produce a hot-rolled sheet; cold-rolling the hot-rolled sheet to produce a cold-rolled sheet; primary recrystallization annealing the cold-rolled sheet; and secondary recrystallization annealing the cold-rolled sheet which is the primary recrystallization annealed.

The step of primary recrystallization annealing comprises a heating step and a soaking step, the step of heating is performed in an atmosphere having an oxygen partial pressure ($P_{H2O}/P_{H2}$) of 0.20 to 0.40, and the step of soaking is performed in an atmosphere having an oxygen partial pressure ($P_{H2O}/P_{H2}$) of 0.50 to 0.70.

The secondary recrystallization annealed steel sheet may comprise 10 pieces or less of inclusions per area of 1 $mm^2$, wherein the inclusions comprise Y and have a diameter of 30 nm to 5 μm.

The slab may further comprise Mn: 0.01% to 0.5%, C: 0.02 to 0.1%, Al: 0.005% or less (excluding 0%), N: 0.0055% or less (excluding 0%) and S: 0.0055% or less (excluding 0%) by wt %.

The slab may further comprise 0.01 to 0.2 wt % of at least one of P, Cu, Cr, Sb, Sn and Mo, respectively.

In the step of heating the slab, heating may be performed at 1000 to 1280° C.

During the primary recrystallization annealing, the step of heating may be heating at a rate of 10° C./s or more.

During the primary recrystallization annealing, the soaking step may be performed at a temperature of 800 to 900° C.

The step of primary recrystallization annealing may be performed in a mixed gas atmosphere of hydrogen and nitrogen.

The step of secondary recrystallization annealing may comprise a temperature-raising step and a soaking step, and the temperature of soaking step may be 900 to 1250° C.

The temperature-raising step of the secondary recrystallization annealing may be performed in a mixed gas atmosphere of hydrogen and nitrogen, and the soaking step of the secondary recrystallization annealing may be performed in hydrogen atmosphere.

Effect of the Invention

The grain-oriented electrical steel sheet according to an embodiment of the present invention is excellent in magnetic properties by stably forming Goss grains.

In addition, since AlN and MnS are not used as the growth inhibitor, it is not necessary to heat the slab at a high temperature of 1300° C. or more.

Further, by forming the inclusions in the steel sheet with a small amount, excellent magnetic flux density and iron loss properties may be obtained.

DETAILED DESCRIPTION OF THE EMBODIMENTS

The first term, second and third term, etc. are used to describe various parts, components, regions, layers and/or sections, but are not limited thereto. These terms are only used to distinguish any part, component, region, layer or section from other part, component, region, layer or section. Therefore, the first part, component, region, layer or section may be referred to as the second part, component, region, layer or section within the scope unless excluded from the scope of the present invention.

The terminology used herein is only to refer specific embodiments and is not intended to be limiting of the invention. The singular forms used herein comprise plural forms as well unless the phrases clearly indicate the opposite meaning. The meaning of the term "comprise" is to specify a particular feature, region, integer, step, operation, element and/or component, not to exclude presence or addition of other features, regions, integers, steps, operations, elements and/or components.

It will be understood that when an element such as a layer, coating, region, or substrate is referred to as being "on" another element, it can be directly on the other element or intervening elements may also be present. In contrast, when an element is referred to as being "directly on" another element, there are no intervening elements present.

Although not defined differently, every term comprising technical and scientific terms used herein have the same meaning as commonly understood by those who is having ordinary knowledge of the technical field to which the present invention belongs. The commonly used predefined terms are further interpreted as having meanings consistent with the relevant technology literature and the present content and are not interpreted as ideal or very formal meanings unless otherwise defined.

In addition, unless otherwise stated, % means wt %, and 1 ppm is 0.0001 wt %.

In an embodiment of the present invention, the meaning further comprising additional elements means that the remainder (Fe) is replaced by additional amounts of the additional elements.

Hereinafter, embodiments of the present invention will be described in detail so that those skilled in the art may easily carry out the present invention. The present invention may, however, be implemented in several different forms and is not limited to the embodiments described herein.

In the conventional grain-oriented electrical steel sheet technology, precipitates such as AlN and MnS are used as grain growth inhibitors. The process conditions were extremely constrained due to the conditions for all the processes to strictly control the distribution of precipitates and to remove the precipitate remaining in the secondary recrystallized steel sheet.

On the other hand, in one embodiment of the present invention, precipitates such as AlN and MnS are not used as the grain growth inhibitor. In one embodiment of the present invention, by using Y as a grain growth inhibitor, the fraction of Goss grains may be increased and an electrical steel sheet excellent in magnetic properties may be obtained. Further, by the maximal suppression of the precipitation of the Y inclusion, excellent magnetic flux density and iron loss properties may be obtained.

The grain-oriented electrical steel sheet according to an embodiment of the present invention comprises: Si: 1.0% to 7.0% and Y: 0.005% to 0.5% by wt %, and the remainder comprising Fe and other inevitable impurities.

Hereinafter, each component will be described in detail.

Yttrium (Y) acts as a grain growth inhibitor in one embodiment of the present invention, thereby suppressing the growth of grains in other orientations other than the Goss grains during secondary recrystallization annealing, thereby improving the magnetic properties of the steel sheet. In the slab and the grain-oriented electrical steel sheet, Y may be comprised in an amount of 0.005 to 0.5 wt %. If the content of Y is too small, it is difficult to exert a sufficient restraining force. On the other hand, if the content of Y is too large, the brittleness of the steel sheet increases and the probability of rolling cracks increases, and a composite phase is formed with Fe, C, N and O to precipitate a large number of inclusions, which adversely affects the magnetic properties of the final product.

Silicon (Si) serves to lower the iron loss by increasing the specific resistance of the material. In the slab and the grain-oriented electrical steel sheet, Si may be comprised in an amount of 1.0 to 7.0 wt %. If the content of Si in the slab and the electrical steel sheet is too small, the specific resistance may be reduced, and the iron loss property may be deteriorated. Conversely, if the content of Si in the grain oriented electrical steel sheet is too large, the processing during manufacturing a transformer may become difficult.

Carbon (C) is an austenite stabilizing element, and it is added to the slab in an amount of 0.02 wt % or more, so that the coarse columnar structure generated during the casting process may be refined and the slab center segregation of S may be suppressed. It may also promote work hardening of the steel sheet during cold rolling, thereby promoting the generation of secondary recrystallization nuclei in {110}<001> orientation in the steel sheet. However, if it exceeds 0.1 wt %, edge-crack may occur in hot rolling. As a result, 0.02 to 0.1 wt % of C may be comprised in the slab.

The decarburization annealing is performed in the primary recrystallization annealing step in the manufacturing process of the grain-oriented electrical steel sheet, and the C content in the final grain-oriented electrical steel sheet produced after decarburization annealing may be 0.005 wt % or less. More specifically, it may be 0.003 wt % or less.

In one embodiment of the present invention, since MnS is not used as a grain growth inhibitor, manganese (Mn) may not be added. However, since Mn is a specific resistance element and has an effect of improving magnetic properties, it may be further comprised as an optional component in slabs and electrical steel sheets. When Mn is further comprised, the content of Mn may be 0.01 wt % or more. However, if it exceeds 0.5 wt %, phase transformation may occur after secondary recrystallization, and the magnetic properties may be deteriorated. In one embodiment of the present invention, when it further comprises additional elements, it is understood that it is added in place of iron (Fe) which is the remainder.

In one embodiment of the present invention, since the precipitates such as AlN and MnS are not used as the grain growth inhibitor, the elements which are essentially used in general grain-oriented electrical steel sheets such as aluminum (Al) and nitrogen (N) sulfur (S) are managed in a range of impurities. That is, when Al, N, S or the like is inevitably comprised, it may further comprise 0.005 wt % or less of Al, 0.006 wt % or less of S, and 0.006 wt % or less of N. More specifically, it may further comprise 0.005 wt % or less of Al, 0.0055 wt % or less of S, and 0.0055 wt % or less of N.

In one embodiment of the present invention, since AlN is not used as a grain growth inhibitor, the content of aluminum (Al) may be aggressively suppressed. Therefore, in one embodiment of the present invention, Al is not added to the grain-oriented electrical steel sheet or may be controlled to 0.005 wt % or less. Further, in the slab, since Al may be removed during the manufacturing process, Al may be comprised in an amount of 0.01 wt % or less.

Since nitrogen (N) forms precipitates such as AlN, (Al, Mn)N, (Al, Si, Mn)N, $Si_3N_4$ and BN, N may not be added or be controlled to 0.006 wt % or less in one embodiment of the present invention. More specifically it may be 0.0030 wt % or less. In one embodiment of the present invention, the nitriding process may be omitted, so that the content of N in the slab and the content of N in the final electrical steel sheet may be substantially the same.

Sulfur (S) is an element having a high dissolution temperature and a high segregation in hot rolling, and therefore may not be added or be controlled to 0.006 wt % or less in one embodiment of the present invention. More specifically, it may be 0.0035 wt % or less.

In one embodiment of the present invention, the grain-oriented electrical steel sheet may further optionally comprise at least one of P, Cu, Cr, Sb, Sn, and Mo in an amount of 0.01 to 0.2 wt % for each component.

Phosphorus (P) increases the number of grains having {110}<001> orientation in the primary recrystallized sheet to lower the iron loss of the final product, and also since the {111}<112> texture is strongly developed in the primary recrystallized sheet to improve the {110}<001> density of the final product, the magnetic flux density is increased, so that it may be added optionally. In addition, P has a function of strengthening the restraining force by segregating the grain boundaries to a high temperature of about 1000° C. in secondary recrystallization annealing. In order to make this action of P work properly, 0.01 wt % or more is required. However, if the content of P is too high, the size of the primary recrystallized grains is rather reduced, which not only makes the secondary recrystallization unstable but also increases the brittleness and hinders the cold rolling property.

Copper (Cu) contributes to the dissolution and micro-precipitation of AlN which is partially present as an austenite forming element, and may complement the grain growth inhibiting power, so that it may be added optionally. However, when the content is increased, there is a disadvantage that the coat layer formed in the secondary recrystallization annealing step is defective.

Chromium (Cr) is a ferrite-expanding element that acts to grow primary recrystallized grains and it increases the grains in the {110}<001> orientation in the primary recrystallized sheet, so that it may be added optionally. On the other hand, if it is added too much, a dense oxide layer is formed on the surface portion of the steel sheet in the simultaneous decarburization and nitriding process, thereby interfering with the nitriding.

Antimony (Sb) and tin (Sn) are segregation elements, which may interfere with the movement of grain boundaries, and may be added optionally, as additional grain growth inhibiting effects may be expected. Also, by increasing the fraction of Goss particles in the primary recrystallized texture and increasing the number of Goss orientations growing in the secondary recrystallized texture, the iron loss properties of the final product may be improved. However, if they are added too much, the brittleness increases, which causes plate breakage during the manufacturing process, and the primary annealing process segregates on the surface and interferes with oxide layer formation and decarburization.

Since molybdenum (Mo) is segregated at grain boundaries during hot rolling to increase the deformation resistance of the steel sheet, the fraction of goss particles in the hot-rolled structure is increased, thereby increasing the magnetic flux density of the steel sheet, so that it may be added optionally. In addition, Mo plays an important role in inhibiting grain growth by segregating in grain boundaries like Sn, and acts to stably control the second recrystallization to occur at a high temperature, thereby increasing the magnetic flux density by acting to grow the Goss particles with more accurate orientation.

In addition, as other inevitable impurities, components such as Ti, Mg, and Ca react with oxygen in the steel to form oxides, which interfere with the magnetic migration of the final product as inclusions, which may cause magnetic deterioration, and thus they should be strongly suppressed. Therefore, when they are inevitably comprised, they may be controlled to 0.005 wt % or less for each component.

A grain-oriented electrical steel sheet according to an embodiment of the present invention comprises 10 pieces or less of inclusions comprising Y and having a diameter of 30 nm to 5 μm per area of 1 $mm^2$. In this case, the diameter of the inclusion means the particle diameter of the imaginary circle circumscribing the inclusion. In one embodiment of the present invention, as a reference when measuring the number of inclusions, the diameter is limited to 30 nm to 5 μm. The inclusions having a diameter of less than 30 nm do not substantially affect the magnetic properties of the grain-oriented electrical steel sheet.

When the steel sheet is magnetized by an external magnetic field, the inclusions interfere with the movement of the internal domain, thereby deteriorating the iron loss property. Therefore, the smaller the number of internal inclusions, the better the magnetic property. In one embodiment of the present invention, the number of inclusions is limited to 10 pieces or less per area of 1 $mm^2$. More specifically, the number of inclusions may be 3 to 9 pieces per area of 1 $mm^2$. The number of inclusions at this time is a case where the number of inclusions is observed on a plane perpendicular to the thickness direction of the steel sheet.

The inclusion comprising Y may be at least one of a carbide of Y, a nitride of Y, an oxide of Y and an Fe—Y compound.

The grain-oriented electrical steel sheet according to an embodiment of the present invention is excellent in magnetic properties by stably forming Goss grains and simultaneously forming fewer inclusions at the same time. Specifically, in the grain-oriented electrical steel sheet according to an embodiment of the present invention, magnetic flux density $B_8$ measured at a magnetic field of 800 A/m may be 1.90 T or more, and an iron loss $W^{17}/_{50}$ measured at 1.7 Tesla and 50 Hz may be 1.10 W/Kg or less.

The method for manufacturing a grain-oriented electrical steel sheet according to an embodiment of the present invention comprises: heating a slab comprising Si: 1.0 to 7.0%, Y: 0.005 to 0.5% by wt %, and the remainder comprising Fe and other inevitable impurities; hot-rolling the slab to produce a hot-rolled sheet; cold-rolling the hot-rolled sheet to produce a cold-rolled sheet; primary recrystallization annealing the cold-rolled sheet; and secondary recrystallization annealing the cold-rolled sheet which is the primary recrystallization annealed.

Hereinafter, a manufacturing method of the grain-oriented electrical steel sheet will be described in detail for each step.

First, the slab is heated.

Since the composition of the slab has been described in detail with respect to the composition of the electrical steel sheet, a duplicate description will be omitted.

The heating temperature of the slab is not limited, but, if the slab is heated to a temperature of 1280° C. or less, it is possible to prevent the columnar structure of the slab from being grown to be coarse, thereby preventing occurring cracks of the sheet in the hot rolling process. Thus, the heating temperature of the slab may be between 1000° C. and 1280° C. In particular, in one embodiment of the present invention, since AlN and MnS are not used as a grain growth inhibitor, it is not necessary to heat the slab at a high temperature exceeding 1300° C.

Then, the slab is hot-rolled to produce a hot-rolled sheet. The hot rolling temperature is not limited, and in one embodiment hot rolling may be terminated at 950° C. or less. Thereafter, it is water-cooled and may be wound at 600° C. or less.

Then, the hot-rolled sheet may be subjected to hot-rolled sheet annealing if necessary. In the case of performing hot-rolled sheet annealing, it may be heated to a temperature of 900° C. or more, cooled and then soaked to make the hot-rolled structure uniform.

Then, the hot-rolled sheet is cold-rolled to produce a cold-rolled sheet. Cold rolling is carried out by using a cold rolling method using a Reverse rolling mill or a Tandom rolling mill by several times of cold rolling methods including one-time cold rolling, several times of cold rolling, or an intermediate annealing to produce a cold-rolled sheet having a thickness of 0.1 mm to 0.5 mm.

Further, warm rolling in which the temperature of the steel sheet is maintained at 100° C. or higher during cold rolling may be performed.

Next, the cold-rolled sheet after cold-rolling is subjected to primary recrystallization annealing. In this process, decarburized and Goss particles are produced.

In the primary recrystallization annealing step, it is important to reduce the amount of residual carbon to 0.005 wt % or less in order to induce Goss grain growth by completely removing the un-decarburized region inside the steel sheet. If a large amount of carbon remains in the steel sheet, Y carbide is formed to act as an inclusion, or magnetic aging of free carbon is generated, which hinders transformer characteristics.

Primary recrystallization occurs in which the nuclei of the Goss grain is generated, together with decarburization in the primary recrystallization annealing step.

The decarburization process is performed in such a manner that the carbon in the steel sheet diffuses into the surface layer and the reacts with oxygen to escape as carbon monoxide (CO) gas, as shown in the following reaction Formula 1.

$$C+H_2O \rightarrow CO\ (gas)+H_2 \qquad \text{[Formula 1]}$$

The carbon in the steel sheet is dissolved in the structure in an amount of about 10 wt % of the total carbon, mostly is present in the structure of pearlite or bainite (locally depending on the cooling pattern) phase transformed from the austenite produced in the hot rolling operation, or locally in the form of fragmented pearlite.

The carbon released and decomposed during the decarburization process should reach the surface layer by diffusion through the ferrite particles and grain boundaries, but at low temperatures, the diffusion rate of carbon is low and the carbon solubility of ferrite is low, so that it does not be released well.

In addition, oxygen should penetrate into the surface layer of the steel sheet and penetrate into the carbon, and the reaction of Scheme 1 should be carried out, but, at a temperature of less than 800° C., the amount of oxygen entering the furnace in the depth direction is insufficient so that the decarburization reaction is not actively performed.

In the temperature range of 800 to 900 □, oxygen starts penetrating into the thickness direction, at this time, the oxygen comes into contact with the carbon and the decarburization reaction takes place in earnest, and the oxygen comes into contact with the inner Si at the same time, so that an $SiO_2$ inner oxide layer is formed.

Therefore, in order to achieve good decarburization, the plate temperature should be raised to 800° C. or higher for the surface diffusion of the internal carbon and the penetration of oxygen into the thickness direction, and at the same time, an oxidizing atmosphere should be formed to penetrate oxygen in the thickness direction.

It is important to note that when the plate temperature is too high in the state where decarburization is not completed, local austenite phase transformation occurs. This phenomenon occurs mainly at the center where decarburization occurs at the latest and hinders grain growth, thereby forming a local microstructure and causing severe tissue irregularities. Therefore, the primary recrystallization annealing is preferably carried out at a temperature lower than 900° C.

In addition, proper oxygen input is very important for decarburization. The amount of oxygen to be supplied should take into account the oxidizing atmosphere (dew point, hydrogen atmosphere), the shape of the oxide layer in the surface layer, and the plate temperature. In general, the oxygen partial pressure ($P_{H2O}/P_{H2}$) may indicate the amount of oxygen in the furnace, but the high oxygen partial pressure does not mean that the decarburization reaction occurs rapidly.

The primary recrystallization annealing step comprises a heating step in which the cold-rolled sheet is heated to the temperature of the above-mentioned soaking step, and a soaking step.

In the primary recrystallization annealing, when the oxidizing ability is excessively high in the heating step, oxides such as $SiO_2$ and Fayalite are formed in the surface layer and the oxide is formed in the surface layer densely, and when these oxides are formed, they interfere with penetration of oxygen in the depth direction, and then interfere with the internal penetration of oxygen.

Si in the steel reacts with moisture present in the annealing atmosphere gas to form an oxide layer, and this tendency increases as the Si content increases. In particular, since Y has better reactivity with oxygen than Si, it is necessary to appropriately control the oxidizing ability of the initial heating step and the subsequent soaking step in the primary recrystallization annealing process. Specifically, in one embodiment of the present invention, the heating step is performed in an atmosphere having an oxygen partial pressure ($P_{H2O}/P_{H2}$) of 0.20 to 0.40, and the soaking step is performed in an atmosphere having an oxygen partial pressure ($P_{H2O}/P_{H2}$) of 0.50 to 0.70. Hereinafter, the reason will be described in detail.

The oxygen partial pressure ($P_{H2O}/P_{H2}$) of the atmosphere is controlled in the range of 0.20 to 0.40 in the heating process in the primary recrystallization annealing step. When the oxygen partial pressure is less than 0.20, the amount of oxygen is insufficient for decarburization, and when the oxygen partial pressure is more than 0.40, a dense oxide layer is initially formed, thereby preventing decarburization in the subsequent soaking process.

The oxygen partial pressure ($P_{H2O}/P_{H2}$) of the atmosphere is controlled in the range of 0.50 to 0.70 in the soaking process in the primary recrystallization annealing step. If the oxygen partial pressure is less than 0.50, it is not sufficient to remove all of the residual carbon in the center of the steel sheet, and if the oxygen partial pressure is more than 0.70, the oxide layer is excessively formed so that not only the surface property of the final product is deteriorated, but also Si and Y oxides are formed and the magnetic properties are adversely affected.

During the first recrystallization annealing, the heating step may be heated at a rate of 10 □/s or higher. If the rate in the heating step is too low, the time may become longer, and it may be disadvantageous for forming the appropriate oxide layer.

The temperature in the soaking step may be 800 to 900 □, as described above.

The primary recrystallization annealing step may be performed in a mixed gas atmosphere of hydrogen and nitrogen. That is, the heating step and the soaking step in the first recrystallization annealing step may be performed in a mixed gas atmosphere of hydrogen and nitrogen.

Further, in the method of manufacturing a grain-oriented electrical steel sheet according to an embodiment of the present invention, the nitriding annealing process after the first recrystallization annealing may be omitted. In the conventional method for producing a grain-oriented electrical steel sheet using AlN as a grain growth inhibitor, nitriding annealing is required for the formation of AlN. However, in the method for manufacturing a grain-oriented electrical steel sheet according to an embodiment of the present invention, since AlN is not used as a grain growth inhibitor, a nitriding annealing process is not necessary and a nitriding process may be omitted.

Then, the cold-rolled sheet, in which the primary recrystallization annealing is completed, is subjected to secondary recrystallization annealing. At this time, after the annealing separator is applied to the cold-rolled sheet in which the primary recrystallization annealing is completed, secondary recrystallization annealing may be performed. At this time, the annealing separator is not particularly limited, and an annealing separator comprising MgO as a main component may be used.

The step of secondary recrystallization annealing comprises a temperature-raising step and a soaking step. The step of temperature-raising is a step of raising the temperature of the cold-rolled sheet after primary recrystallization annealing to the temperature of the soaking step. The temperature of the soaking step may be 900 □ to 1250 □. If the temperature is less than 900° C., the Goss grains may not sufficiently grow and the magnetic properties may deteriorate, and when the temperature exceeds 1250° C., the grains may grow to be coarse so that the characteristics of the electrical steel sheet may deteriorate. The step of temperature-raising of the secondary recrystallization annealing may be performed in a mixed gas atmosphere of hydrogen and nitrogen, and the step of soaking may be performed in hydrogen atmosphere.

In the method for manufacturing a grain-oriented electrical steel sheet according to an embodiment of the present invention, since the grain growth inhibitor such as AlN or MnS is not used, the purification annealing process may be omitted after the secondary recrystallization annealing is completed. In the conventional method for manufacturing a grain-oriented electrical steel sheet using MnS and AlN as a grain growth inhibitor, high-temperature annealing for removing precipitates such as AlN and MnS is required, but, in the method for manufacturing a grain-oriented electrical steel sheet according to an embodiment of the present invention, the purification annealing process may not be necessary.

The secondary recrystallized annealed steel sheet may comprise 10 pieces or less of inclusions comprising Y and having a diameter of 30 nm to 5 μm per area of 1 $mm^2$. The description of the inclusions is the same as that described above, so duplicate explanations are omitted. In one embodiment of the present invention, by precisely controlling the oxygen partial pressure in the first recrystallization annealing step, less inclusions may be precipitated and ultimately the magnetic property may be improved.

Thereafter, an insulation coating may be formed on the surface of the grain-oriented electrical steel sheet or a treatment of refining the magnetic domain may be carried out, if necessary. In one embodiment of the present invention, the alloy component of the grain-oriented electrical steel sheet refers to a substrate steel sheet excluding a coating layer such as an insulation coating.

Hereinafter, the present invention will be described in more detail with reference to examples. However, these examples are only for illustrating the present invention, and the present invention is not limited thereto.

EXAMPLE 1

A slab comprising Si: 3.15%, C: 0.053%, Y: 0.08%, Mn: 0.1%, S: 0.0045%, N: 0.0028% and Al: 0.008% by wt %, with the remainder consisting of Fe and other inevitable impurities was prepared.

The slab was heated at a temperature of 1150 ⊏ for 90 minutes, and hot-rolled to produce a hot-rolled sheet having a thickness of 2.6 mm. The hot-rolled sheet was heated to a temperature of 1050 ⊔ or higher and held at 930 ⊔ for 90 seconds, cooled with water and pickled. Followed by cold rolling to a thickness of 0.30 mm using a Reverse mill. The cold-rolled steel sheet was heated, in a mixed gas atmosphere of hydrogen: 50 vol % and nitrogen: 50 vol %, at a rate of 50° C./s up to the soaking temperature in the heating step and was subjected to primay recrystallization annealing by keeping it for 120 seconds while changing the oxygen partial pressure ($P_{H2O}/P_{H2}$) and the conditions of the soaking temperature as shown in Table 1, so that the content of the carbon in the steel sheet was 0.003 wt % or less.

Thereafter, MgO was applied and then wound in a type of a coil to perform secondary recrystallization annealing. The secondary recrystallization annealing was temperature-raised in a mixed gas atmosphere of nitrogen: 25 vol % and hydrogen: 75 vol % until 1200° C. at a rate of 15° C./hr, and after reaching 1200° C., the secondary recrystallization annealing was maintained in a gas atmosphere of hydrogen: 100 vol % for 20 hours and then furnace cooled.

After the surface of final steel sheet was cleaned, and then the magnetic flux density was measured at a magnetic field strength of 800 A/m and iron loss was measured at 1.7 Tesla and 50 Hz, using a single sheet measurement method.

Further, the number of Y inclusions having a size of 5 μm or less in the steel sheet was measured using SEM-EDS.

TABLE 1

| Sample number | Soaking temperature (° C.) | Heating Step Oxygen partial pressure | Soaking Step Oxygen partial pressure | Magnetic Flux Density ($B_8$, Tesla) | Iron Loss ($W_{17/50}$, W/kg) | Number of inclusions (pieces/$mm^2$) | Remarks |
|---|---|---|---|---|---|---|---|
| 1 | 750 | 0.31 | 0.66 | 1.82 | 2.05 | 35 | Comparative material |
| 2 | 800 | 0.28 | 0.59 | 1.91 | 1.05 | 8 | Invention material |
| 3 | 820 | 0.17 | 0.68 | 1.87 | 1.89 | 18 | Comparative material |
| 4 | 820 | 0.36 | 0.75 | 1.84 | 2.14 | 22 | Comparative material |
| 5 | 845 | 0.33 | 0.61 | 1.90 | 0.99 | 6 | Invention material |
| 6 | 855 | 0.30 | 0.58 | 1.90 | 1.01 | 9 | Invention material |
| 7 | 855 | 0.39 | 0.66 | 1.91 | 1.02 | 9 | Invention material |
| 8 | 855 | 0.42 | 0.58 | 1.90 | 1.96 | 23 | Comparative material |
| 9 | 870 | 0.35 | 0.63 | 1.92 | 0.96 | 5 | Invention material |
| 10 | 910 | 0.26 | 0.54 | 1.89 | 1.88 | 13 | Comparative material |

As shown in Table 1, it was confirmed that the invention material having properly controlled the soaking temperature of the primary recrystallization annealing and the oxygen partial pressure in the heating step and the soaking step has a better magnetic property and fewer inclusions than the comparative material.

EXAMPLE 2

A slab comprising Si: 3.35%, C: 0.058%, Y: 0.12%, Mn: 0.06%, S: 0.0030%, N: 0.0030%, Al: 0.005%, P: 0.015%, Cu: 0.02% and C: 0.03% by wt %, with the remainder consisting of Fe and other inevitable impurities was prepared.

The slab was heated at a temperature of 1150° C. for 90 minutes, and hot-rolled to produce a hot-rolled sheet having a thickness of 2.3 mm. The hot-rolled sheet was heated to a temperature of 1050° C. or higher and held at 910° C. for 90 seconds, cooled with water and pickled. Followed by cold rolling to a thickness of 0.23 mm using a Reverse mill. The cold-rolled steel sheet was heated, in a mixed gas atmosphere of hydrogen: 50 vol % and nitrogen: 50 vol %, at a rate of 50° C./s up to the soaking temperature in the heating step and was subjected to primay recrystallization annealing by keeping it for 120 seconds in the soacking temperature of 850° C. while changing the oxygen partial pressure ($P_{H2O}/P_{H2}$) as shown in Table 2. Thereafter, MgO was applied and then wound in a type of a coil to perform secondary recrystallization annealing. The secondary recrystallization annealing was temperature-raised in a mixed gas atmosphere of nitrogen: 25 vol % and hydrogen: 75 vol % until 1200° C. at a rate of 15° C./hr, and after reaching 1200° C., the secondary recrystallization annealing was maintained in a gas atmosphere of hydrogen: 100 vol % for 20 hours and then furnace cooled.

After the surface of final steel sheet was cleaned, and then the magnetic flux density was measured at a magnetic field strength of 800 A/m and iron loss was measured at 1.7 Tesla and 50 Hz, using a single sheet measurement method.

In addition, the number and components of inclusions in the steel sheet were measured using SEM-EDS.

TABLE 2

| Sample number | Heating Step Oxygen partial pressure | Soaking Step Oxygen partial pressure | Magnetic Flux Density ($B_8$, Tesla) | Iron Loss ($W_{17/50}$, W/kg) | Number of inclusions (pieces/mm$^2$) | Types of inclusions | Remarks |
|---|---|---|---|---|---|---|---|
| 11 | 0.33 | 0.57 | 1.91 | 0.92 | 6 | Carbide | Invention material |
| 12 | 0.34 | 0.48 | 1.85 | 2.11 | 13 | Carbide, Fe—Y Compound | Comparative material |
| 13 | 0.48 | 0.45 | 1.84 | 2.39 | 21 | Carbide, Oxide | Comparative material |
| 14 | 0.18 | 0.53 | 1.79 | 2.24 | 20 | Fe—Y Compound, Nitride | Comparative material |
| 15 | 0.36 | 0.60 | 1.90 | 0.88 | 8 | Carbide | Invention material |
| 16 | 0.36 | 0.64 | 1.91 | 0.84 | 3 | Fe—Y Compound | Invention material |
| 17 | 0.28 | 0.58 | 1.91 | 0.93 | 6 | Fe—Y Compound | Invention material |
| 18 | 0.31 | 0.75 | 1.89 | 1.56 | 17 | Carbide, Oxide | Comparative material |

As shown in Table 2, it was confirmed that the invention material having properly controlled the soaking temperature of the primary recrystallization annealing and the oxygen partial pressure in the heating step and the soaking step has a better magnetic property and fewer inclusions than the comparative material. As a result of the measurement of the components of the inclusions, all of them are composite compounds comprising Y, and their types comprise one or more of carbide, nitride, oxide of Y and Fe—Y compounds.

The present invention is not limited to the above-mentioned examples or embodiments and may be manufactured in various forms, those who have ordinary knowledge of the technical field to which the present invention belongs may understand that it may be carried out in different and concrete forms without changing the technical idea or fundamental feature of the present invention. Therefore, the above-mentioned examples or embodiments are illustrative in all aspects and not limitative.

The invention claimed is:

1. A grain-oriented electrical steel sheet comprising:

Si: 1.0 to 7.0% and Y: 0.005 to 0.5% by wt %, and the remainder comprising Fe and other inevitable impurities, and 3 to 9 pieces of inclusions comprising Y and having a diameter of 30 nm to 5 μm per area of 1 mm$^2$.

2. The grain-oriented electrical steel sheet of claim 1, further comprising Mn: 0.01% to 0.5%, C: 0.005% or less (excluding 0%), Al: 0.005% or less (excluding 0%), N: 0.006% or less (excluding 0%) and S: 0.006% or less (excluding 0%) by wt %.

3. The grain-oriented electrical steel sheet of claim 1, further comprising 0.01 to 0.2 wt % of at least one of P, Cu, Cr, Sb, Sn and Mo, respectively singly or in a total amount.

4. The grain-oriented electrical steel sheet of claim 1, wherein, the inclusions comprise at least one of a carbide of Y, a nitride of Y, an oxide of Y, and an Fe—Y compound.

5. A method for manufacturing the grain-oriented electrical steel sheet of claim 1, the method comprising:

heating a slab comprising Si: 1.0 to 7.0%, Y: 0.005 to 0.5% by wt %, and the remainder comprising Fe and other inevitable impurities;

hot-rolling the slab to produce a hot-rolled sheet;

cold-rolling the hot-rolled sheet to produce a cold-rolled sheet;

primary recrystallization annealing the cold-rolled sheet; and secondary recrystallization annealing the cold-rolled sheet which is the primary recrystallization annealed;

wherein the step of the primary recrystallization annealing comprises a heating step and a soaking step, the heating step is performed in an atmosphere having an oxygen partial pressure ($P_{H2O}/P_{H2}$) of 0.20 to 0.40, and the soaking step of soaking is performed in an atmosphere having an oxygen partial pressure ($P_{H2O}/P_{H2}$) of 0.50 to 0.70.

6. The method of claim 5, wherein, the slab further comprises Mn: 0.01% to 0.5%, C: 0.02 to 0.1%, Al: 0.01% or less (excluding 0%), N: 0.006% or less (excluding 0%) and S: 0.006% or less (excluding 0%) by wt %.

7. The method of claim 5, wherein, the slab further comprises 0.01 to 0.2 wt % of at least one of P, Cu, Cr, Sb, Sn and Mo, respectively singly or in a total amount.

8. The method of claim 5, wherein, in the step of the heating the slab, heating is performed at 1000 to 1280° C.

9. The method of claim 5, wherein, the heating step of the primary recrystallization annealing is heating at a rate of 10° C./s or more.

10. The method of claim 5, wherein, the soaking step is performed at a temperature of 800 to 900° C.

11. The method of claim 5, wherein, the step of the primary recrystallization annealing is performed in a mixed gas atmosphere of hydrogen and nitrogen.

12. The method of claim 5, wherein, the step of the secondary recrystallization annealing comprises a temperature-raising step and a soaking step, and a temperature of the soaking step is 900 to 1250° C.

13. The method of claim 12, wherein, the temperature-raising step of the secondary recrystallization annealing is performed in a mixed gas atmosphere of hydrogen and nitrogen, and the soaking step of the secondary recrystallization annealing is performed in hydrogen atmosphere.

14. A grain-oriented electrical steel sheet consisting of:

Si: 1.0 to 7.0% and Y: 0.005 to 0.5% by wt %, and the remainder consisting of Fe and other inevitable impurities, and 3 to 9 pieces of inclusions comprising Y and having a diameter of 30 nm to 5 μm per area of 1 mm$^2$, wherein the grain-oriented electrical steel sheet optionally consists of: Mn: 0.01% to 0.5%, C: 0.005% or less (excluding 0%), Al: 0.005% or less (excluding 0%), N: 0.006% or less (excluding 0%) or S: 0.006% or less (excluding 0%) by wt %, and optionally further consists of: 0.01 to 0.2 wt % of at least one of P, Cu, Cr, Sb, Sn and Mo, respectively singly or in a total amount.

15. The grain-oriented electrical steel sheet of claim 14 consisting of:

Si: 1.0 to 7.0% and Y: 0.005 to 0.5% by wt %, and the remainder consisting of Fe and other inevitable impurities.

16. The grain-oriented electrical steel sheet of claim 14, wherein the grain-oriented electrical steel sheet does not include Ba as a grain growth inhibitor.

* * * * *